US007236133B2

(12) United States Patent
Ohara

(10) Patent No.: US 7,236,133 B2
(45) Date of Patent: Jun. 26, 2007

(54) ANTENNA SYSTEM

(75) Inventor: Katsuhiro Ohara, Obu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/147,475

(22) Filed: Jun. 8, 2005

(65) Prior Publication Data

US 2005/0275598 A1 Dec. 15, 2005

(30) Foreign Application Priority Data

Jun. 9, 2004 (JP) ..... 2004-171123

(51) Int. Cl.
*H01Q 1/24* (2006.01)
*H01Q 21/00* (2006.01)

(52) U.S. Cl. ..... 343/702; 343/844

(58) Field of Classification Search ..... 343/702, 343/700 MS, 846, 844
See application file for complete search history.

(56) References Cited

U.S. PATENT DOCUMENTS 5,966,097 A * 10/1999 Fukasawa et al. ... 343/700 MS
6,570,538 B2 * 5/2003 Vaisanen et al. ..... 343/702
6,768,460 B2 * 7/2004 Hoashi et al. ..... 343/700 MS
6,807,401 B2 10/2004 Boyle

* cited by examiner

*Primary Examiner*—Hoang V. Nguyen
(74) *Attorney, Agent, or Firm*—Harness, Dickey & Pierce, PLC

(57) ABSTRACT

A compact and low-lying antenna system for receiving a radio wave includes a ground plate, a first crooked monopole antenna having a horizontal portion extending in parallel with the ground plate and a vertical portion extending vertically to the ground plate in such that the length of the horizontal portion and the vertical portion is approximately a quarter of the radio wave length, a second crooked monopole antenna having a horizontal portion extending in parallel with the ground plate and a vertical portion extending vertically to the ground plate in such that the length of the horizontal portion and the vertical portion is approximately a quarter of the radio wave length. The first and second antennas are disposed side by side at a distance that is approximately a quarter of the radio wave length.

3 Claims, 4 Drawing Sheets

ANTENNA SYSTEM

CROSS REFERENCE TO RELATED APPLICATION

The present application is based on and claims priority from Japanese Patent Application 2004-171123, filed Jun. 9, 2004, the contents of which are incorporated herein by reference.

BACKGROUND OF THE INVENTION

1. Field of the Invention

The present invention relates to an antenna system to be mounted in a vehicle and, more particularly, a diversity reception system.

2. Description of the Related Art

U.S. Pat. No. 6,807,401 B2 or P2003-528520A, which is a counterpart foreign patent application of the former patent, discloses a diversity reception system formed of a plurality of antennas each directivity response pattern of which is covered by another by shifting the phase of a signal supplied to one antenna from the phase of another signal supplied to another antenna. However it is necessary to provide an additional circuit for shifting the signal phase, which increases the cost and size of the diversity reception system.

SUMMARY OF THE INVENTION

Therefore, a main object of the invention is to provide a compact low-lying vehicular antenna that can cover the directivity response pattern of another when a diversity reception system is formed, thereby increasing vertical gain of the antenna without any additional circuit or component.

According to an embodiment of the invention, an antenna system includes a ground plate, a first crooked monopole antenna having a horizontal portion extending in parallel with the ground plate and a vertical portion extending vertically to the ground plate in such that the length of the horizontal portion and the vertical portion is approximately a quarter of the radio wave length or its integral multiple, a second crooked monopole antenna having a horizontal portion extending in parallel with the ground plate and a vertical portion extending vertically to the ground plate in such that the length of the horizontal portion and the vertical portion being approximately a quarter of the radio wave length. In the above system the first and second antennas are disposed side by side at a distance of approximately a quarter of the radio wave length.

Therefore, a low-lying compact antenna system can be provided without an additional circuit or component.

In the antenna system one of the crooked monopole antennas may include a U-turned member having a pair of horizontal portions and a pair of vertical portions.

This structure can increase antenna current and induced antenna current, so that magnetic field strength can be increased.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A vehicular antenna system according to the first embodiment of the invention will be described with reference to FIGS. 1, 2A, 2B, 3A, 3B, 3C and 3D.

Figure 1:
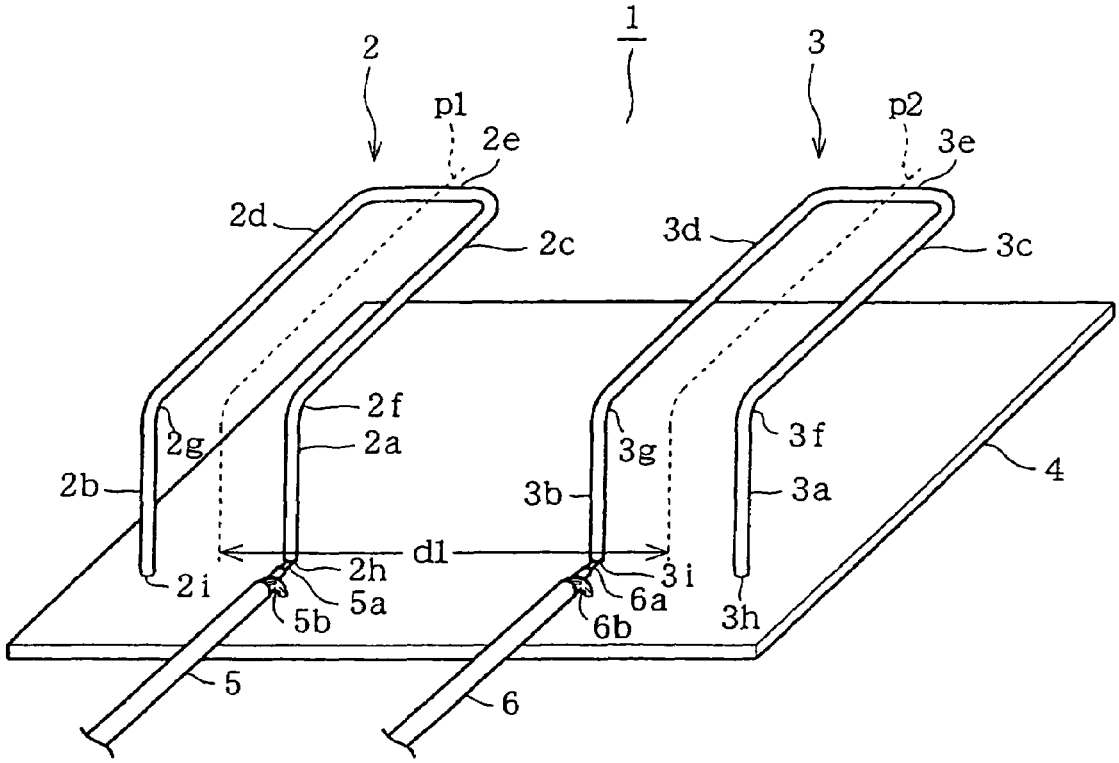
FIG. 1 is a perspective view of an antenna system according to the first embodiment of the invention.

As shown in FIG. 1, a low-lying antenna system 1 to be mounted in a vehicle includes a first antenna 2, a second antennas 3 and a ground plate 4. The first and second antenna 2, 3 are disposed on the ground plate 4 to form a diversity reception system.

The first antenna 2 is a crooked U-turned monopole antenna that has a pair of vertical portions 2*a*, 2*b*, a pair of horizontal portions 2*c*, 2*d* extending from bent portions 2*f*, 2*g* in parallel with each other in a horizontal direction and a central turn portion 2*e*. The total length of the first antenna 2 is approximately a half of the length of a radio wave (e.g. 800 MHz) to be received. In other words, the total length of the vertical portion 2*a* and the horizontal portion 2*c* is approximately a quarter of the radio wave to be received, and the total length of the vertical portion 2*b* and the horizontal portion 2*d* is approximately a quarter of the radio wave to be received. The total length of the vertical portion and the horizontal portion may be an integral multiple of a quarter of the radio wave to be received.

The second antenna 3 is of the same type. It also a crooked U-turned monopole antenna that has a pair of vertical portions 3*a*, 3*b*, a pair of horizontal portions 3*c*, 3*d* extending from bent portions 3*f*, 3*g* in parallel with each other in a horizontal direction and a central turn portion 3*e*. The second antenna 3 also has approximately a half of the length of the radio wave. In other words, the total length of one of the vertical portions 3*a* and one of the horizontal portions 3*c* is approximately a quarter of the radio wave to be received, and the total length of one of the vertical portions 3*b* and one of the horizontal portions 3*d* is approximately a quarter of the radio wave to be received. The total length of the vertical portion and the horizontal portion may be an integral multiple of a quarter of the radio wave to be received.

The first and second antennas are disposed side by side at a distance d1 (between p1 which is the center line between 2*d* and 2*c* and p2 which is the center line between 3*d* and 3*c*) that is a quarter of the radio wave to be received. The first antenna 2 is connected with a coaxial cable 5, and the second antenna 3 is connected with a coaxial cable 6. The coaxial cable 5 includes an internal conductor 5*a* that is connected to an end 2*h* of the first antenna 2 and an external cable 5*b* that is connected to the ground plate 4. The coaxial cable 6 also includes an internal conductor 6*a* that is connected to an end 3*i* of the second antenna 3 and an external cable 6*b* that is connected to the ground plate 4.

The other end 2*i* of the first antenna 2 and the other end 3*h* of the second antenna 3 are respectively disposed to float above the ground plate 4 at a preset distance from the ground plate 4.

Figure 2A:
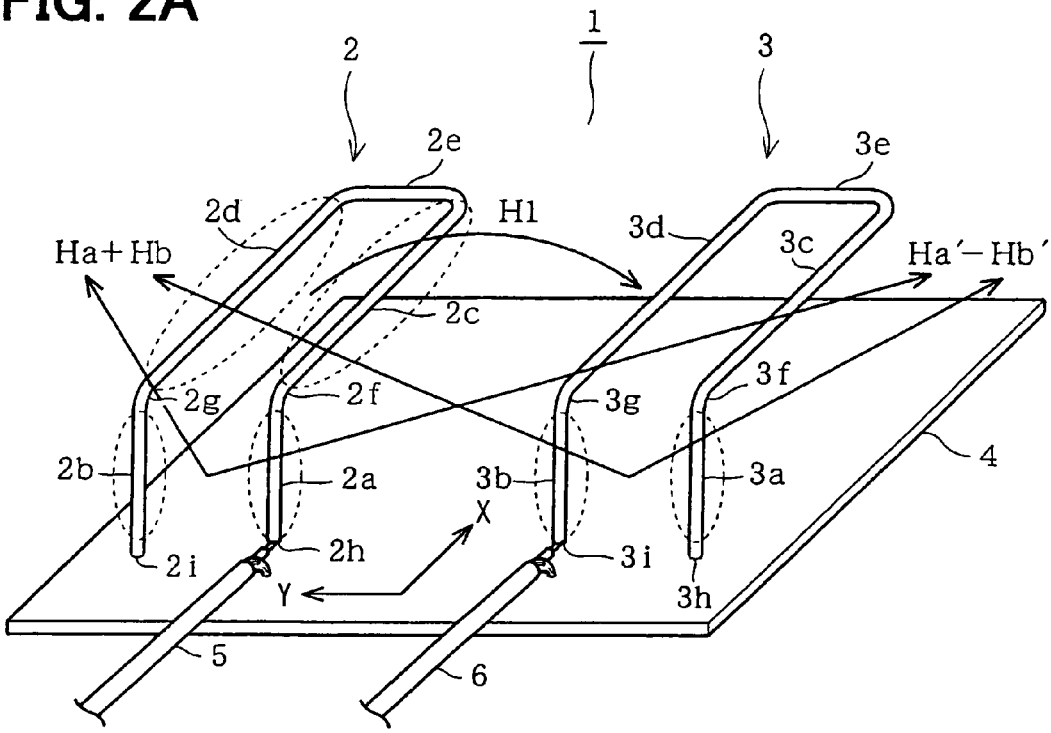
FIGS. 2A and 2B respectively illustrate magnetic fields generated by the antenna system according to the first embodiment of the invention.

When the first antenna 2 is powered via the coaxial cables 5, antenna current flows through the horizontal portions 2*c*, 2*d* of the first antenna 2. Therefore, a horizontal magnetic field H1 is generated around the horizontal portions 2*c*, 2*d*, and current is induced in the horizontal portion 3*c* , 3*d* of the second antenna 3 and in the vertical portions 3*a* , 3*b* due to the magnetic field H1, as shown in FIG. 2A. As a result, vertical magnetic fields Ha, Ha' are generated by the current flowing through the vertical portions 2*a*, 2*b* of the first antenna 2, and vertical magnetic fields Hb, Hb' are generated by current induced in the vertical portions 3*a*, 3*b* of the second antenna 3. Because the first antenna 2 and the second antenna 3 are spaced apart from each other by a quarter of the radio wave length to be received, the vertical magnetic field Ha of the first antenna 2 and the vertical magnetic field Hb are intensified (i.e. Ha+Hb) by each other on the side of the first antenna 2 and weakens (i.e. Ha'−Hb') by each other on the side of the second antenna 3.

Figure 2B:
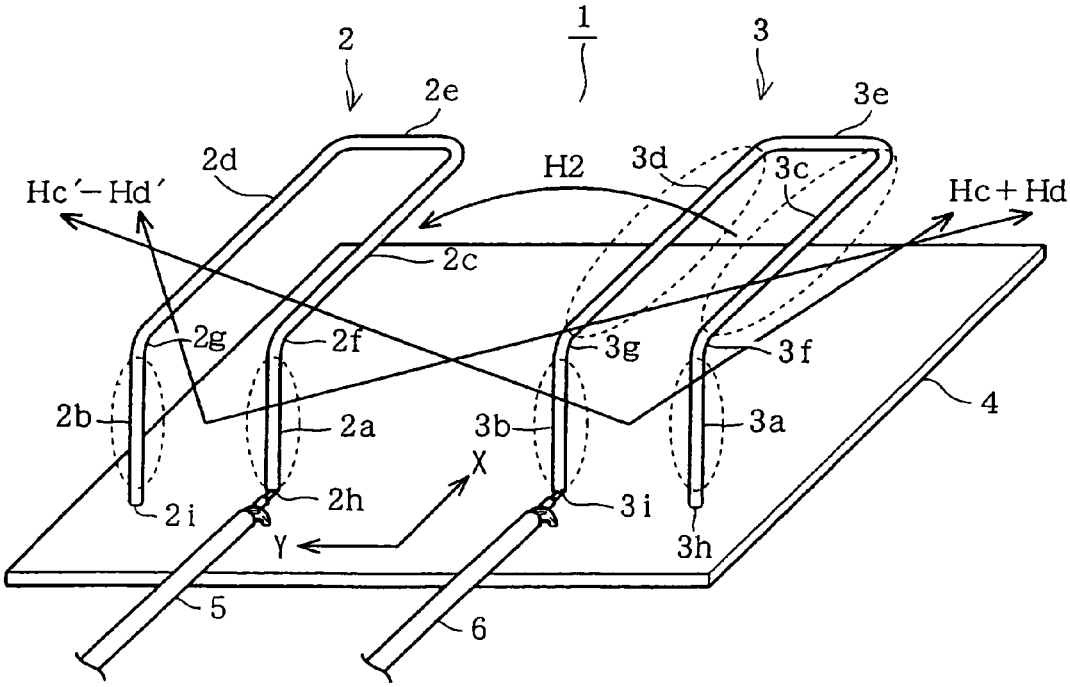

When the second antenna 3 is powered via the coaxial cables 6, antenna current flows through the horizontal portions 3*c*, 3*d* of the second antenna 3. Therefore, a horizontal magnetic field H2 is generated around the horizontal portions 3*c*, 3*d*, and current is induced in the horizontal portion 2*c*, 2*d* of the first antenna 2 and in the vertical portions 2*a*, 2*b* due to the magnetic field H2, as shown in FIG. 2B. As a result, vertical magnetic fields Hc, Hd' are generated by the current flowing through the vertical portions 3*a*, 3*b*, and vertical magnetic fields Hd, Hd' are generated by current induced in the vertical portions 2*a*, 2*b* of the first antenna 2. Because the first antenna 2 and the second antenna 3 are spaced apart from each other by a quarter of the radio wave length to be received, the vertical magnetic field Ha and the vertical magnetic field Hb are intensified (i.e. Hc+Hd) by each other on the side of the second antenna 3 and weakens (i.e. Hc'−Hd') by each other on the side of the second antenna 3.

Figure 3B:
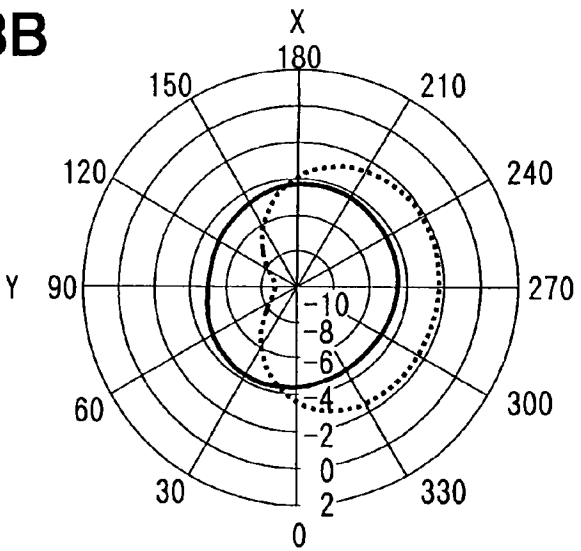
FIGS. 3A, 3B, 3C and 3D are graphs showing directivity response patterns of the antenna system.
Figure 3A:
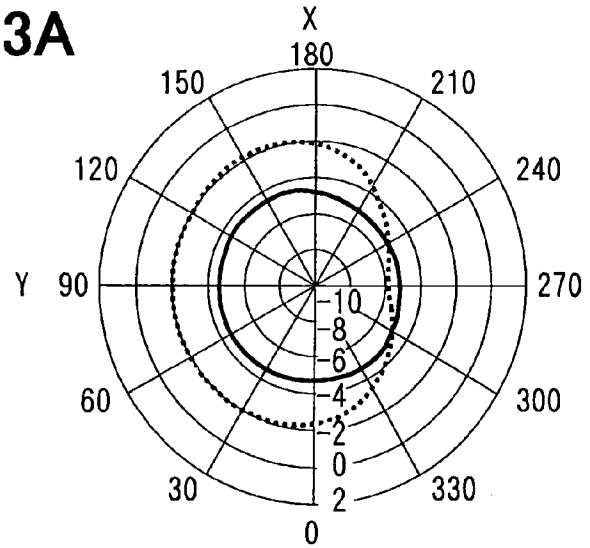

FIG. 3A shows the vertical component of the directivity response pattern of the first antenna 2, in which the vertical component of the magnetic field Ha generated by the first antenna 2 and the vertical component of the magnetic field Hb generated by the second antenna are intensified by each other at the plus-Y side which corresponds to the side of the first antenna 2, as indicated by a dotted line.

FIG. 3B shows the vertical component of the directivity response pattern of the second antenna 3, in which the vertical component of the magnetic field Hc generated by the second antenna 3 and the vertical component of the magnetic field Hd generated by the first antenna 2 are intensified by each other at the minus-Y side which corresponds to the side of the second antenna 3, as indicated by a dotted line.

Figure 3D:
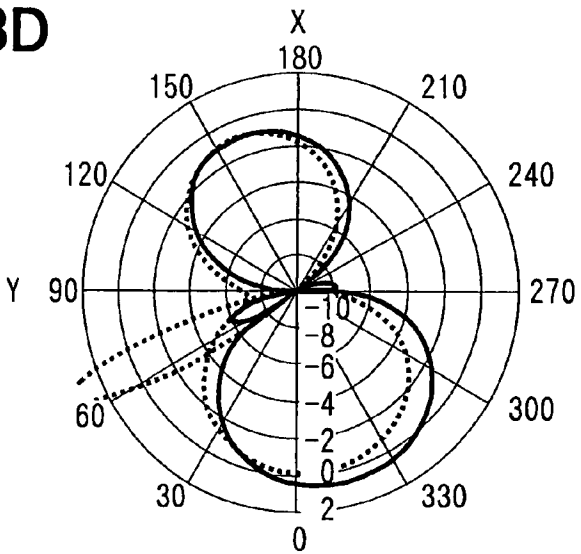
Figure 3C:
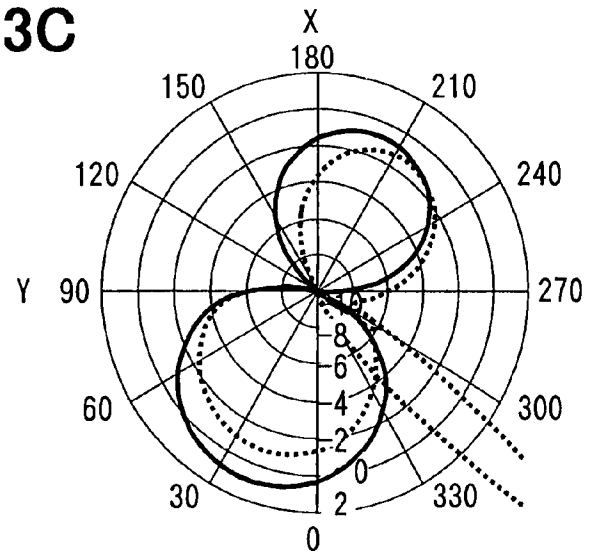

FIG. 3C shows the horizontal component of the directivity response pattern of the first antenna 2, and FIG. 3D shows the horizontal component of the directivity response pattern of the second antenna 2. It is noted that the horizontal component of the, directivity response pattern of the antenna system indicated by a dotted line is reduced in size from that of the single antenna indicated by a solid line. Incidentally, solid lines in FIGS. 3A, 3B and 3C indicate directivity response patterns of the first and the second antenna when only one of the first and second antenna exists.

Thus, a low-lying antenna system, in which the vertical component of the magnetic fields generated by the first and second antennas 3, 4 are intensified by each other, is provided.

A low-lying antenna system 11 according to the second embodiment of the invention will be described with reference to FIG. 4.

Incidentally, the same reference numeral corresponds to the same or substantially the same part, component or portion as the first embodiment.

Figure 4:
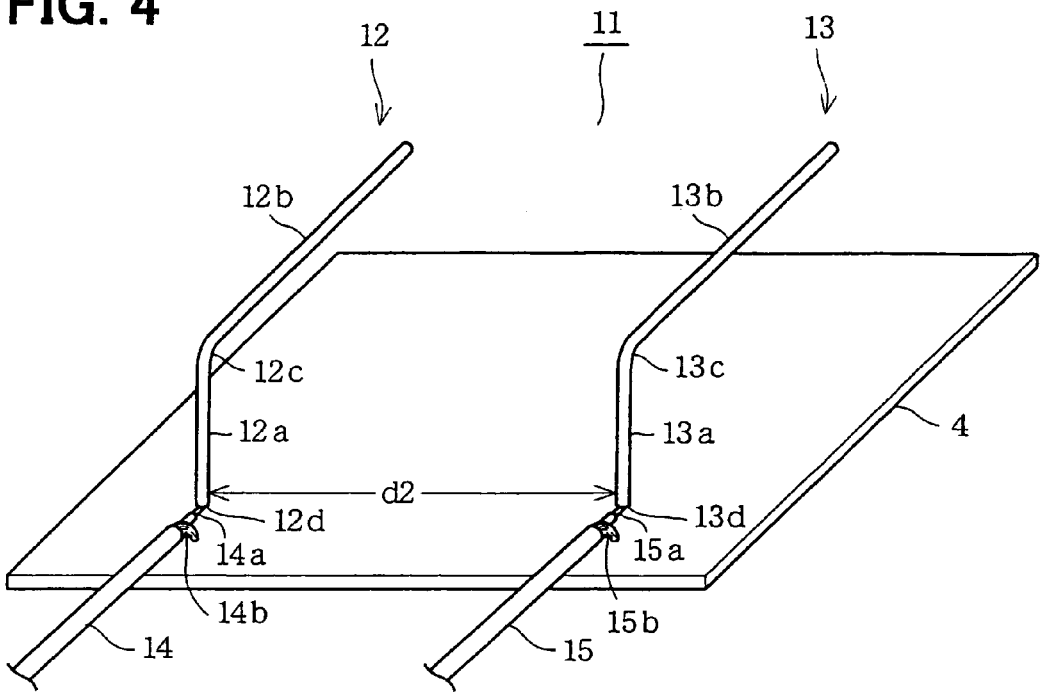
FIG. 4 is a perspective view of an antenna system according to the second embodiment of the invention.

As shown in FIG. 4, the antenna system 11 includes a first antenna 12, a second antennas 13 and a ground plate 4. The first and second antenna 12, 13 are disposed on the ground plate 4 to form a diversity reception system. The first antenna 12 is a crooked monopole antenna that has a vertical portion 12*a*, a horizontal portion 12*b* extending from a bent portion 12*c* in a horizontal direction. The first antenna 12 has a quarter length of a radio wave (e.g. 800 MHz) to receive. The total length of the vertical portion and the horizontal portion may be an integral multiple of a quarter of the radio wave to be received.

The second antenna 13 is of the same type. It also a crooked monopole antenna that has a vertical portions 13*a*, a horizontal portion 13*b* extending from a bent portions 13*c* in a horizontal direction. The second antenna 2 also has a quarter length of the radio wave (e.g. 800 MHz) to be receive. The total length of the vertical portion and the horizontal portion may be an integral multiple of a quarter of the radio wave to be received.

The first and second antennas 12, 13 are disposed side by side at a distance d2 (between 12*b* and 13*b*) that is a quarter of the radio wave to be received. The first antenna 12 is connected with a coaxial cable 14, and the second antenna 13 is connected with a coaxial cable 15. The coaxial cable 14 includes an internal conductor 14*a* that is connected to an end 12*d* of the first antenna 12 and an external cable 14*b* that is connected to the ground plate 4. The coaxial cable 15 also includes an internal conductor 15*a* that is connected to an end 13*d* of the second antenna 3 and an external cable 15*b* that is connected to the ground plate 4.

When the first antenna 12 is powered via the coaxial cables 14, antenna current flows through the horizontal portions 12*b* of the first antenna 12. Therefore, a horizontal magnetic field is generated around the horizontal portions 12*b*, and current is induced in the horizontal portion 13*b* of the second antenna 13 and in the vertical portions 13*a*. As a result, a vertical magnetic field is generated by the current flowing through the vertical portion 12*a* of the first antenna 12, and another vertical magnetic field is generated by current induced in the vertical portion 13*a* of the second antenna 13. Because the first antenna 12 and the second antenna 13 are spaced apart from each other by a quarter of the radio wave length to be received, the vertical magnetic field of the first antenna 12 and the vertical magnetic field of the second antenna 13 are intensified by each other on the side of the first antenna 12. Thus, this antenna system functions as an array antenna.

An antenna system 21 according to the third embodiment of the invention will be described with reference to FIG. 5.

Figure 5:
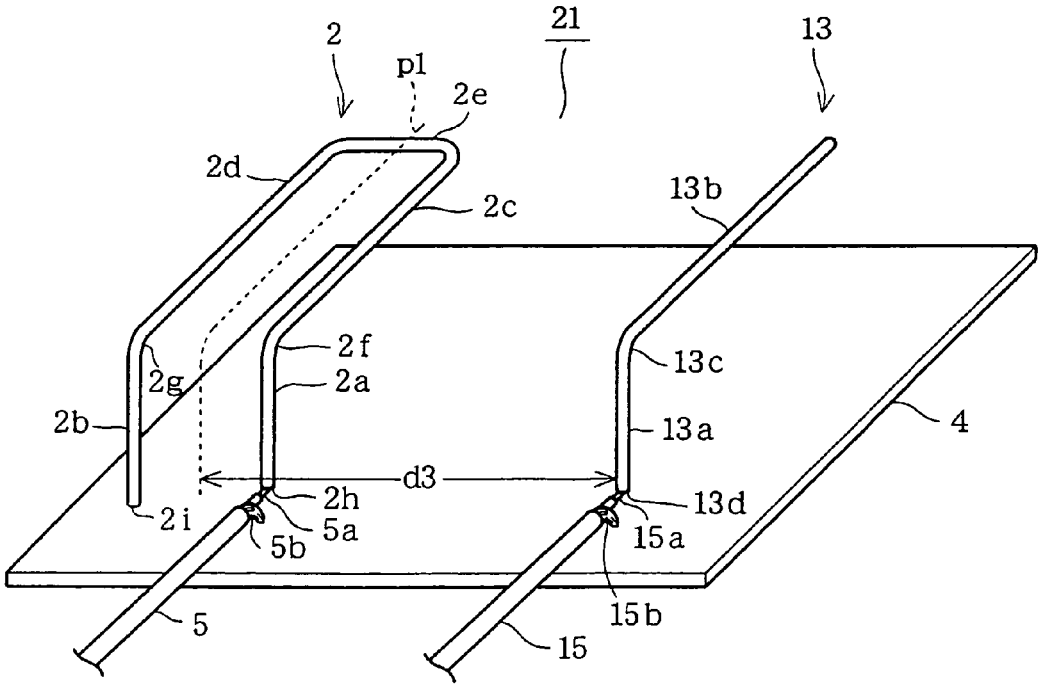
FIG. 5 is a perspective view of an antenna system according to the third embodiment of the invention.

As shown in FIG. 5, the antenna system 21 includes the same first antenna 2 as that of the first embodiment, the same second antenna 13 as the second embodiment and a ground plate 4. The first and second antenna 2, 13 are disposed on the ground plate 4 to form a diversity reception system.

The first and second antennas 2, 13 are disposed side by side at a distance d3 (between p1 which is the center line between 2*d* and 2*c* and 13*b*) that is a quarter of the radio wave to be received.

When the first antenna 2 is powered via the coaxial cables 5, antenna current flows through the horizontal portions 2*c*, 2*d*, as described above. Therefore, a horizontal magnetic field is generated in the same manner as the first embodiment. Because the first antenna 2 and the second antenna 13 are spaced apart from each other by a quarter of the radio wave length to be received, the vertical magnetic field of the first antenna 2 and the vertical magnetic field of the second antenna 13 are intensified by each other on the side of the first antenna 2.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An antenna system for receiving a radio wave comprising:

a ground plate;

a first crooked monopole antenna having a horizontal portion extending in parallel with said ground plate and a vertical portion extending vertically to said ground plate, the length of the horizontal portion and the vertical portion being approximately an integral multiple of a quarter of the radio wave length;

a second crooked monopole antenna having a horizontal portion extending in parallel with said ground plate and a vertical portion extending vertically to said ground plate, the length of the horizontal portion and the vertical portion being approximately an integral multiple of a quarter of the radio wave length;

wherein said first and second antennas are disposed side by side at a distance that is approximately a quarter of the radio wave length.

2. The antenna system as claimed in claim 1, wherein one of said crooked monopole antennas comprises a U-turned member having a pair of horizontal portions and a pair of vertical portions.

3. An antenna system for receiving a radio wave comprising:

a ground plate;

a first U-turn crooked monopole antenna having a pair of horizontal portions extending in parallel with said ground plate and a pair of vertical portions extending vertically to said ground plate, the total length of the horizontal portion and the vertical portion being approximately an integral multiple of a quarter of the radio wave length;

a second crooked monopole antenna having a pair of horizontal portions extending in parallel with said ground plate and a pair of vertical portions extending vertically to said ground plate, the total length of the horizontal portion and the vertical portion being approximately an integral multiple of a quarter of the radio wave length;

wherein said first and second antennas are disposed side by side at a distance that is approximately a quarter of the radio wave length.

* * * * *